United States Patent [19]

Ruseff et al.

[11] 4,014,628

[45] Mar. 29, 1977

[54] SUPERCHARGED THREE-SECTION PUMP

[75] Inventors: Walter Zdzislaw Ruseff, New Lenox; Gilbert Tribley, Joliet, both of Ill.

[73] Assignee: Caterpillar Tractor Co., Peoria, Ill.

[22] Filed: May 15, 1975

[21] Appl. No.: 577,808

[52] U.S. Cl. ..... 417/203; 91/499

[51] Int. Cl.[2] ..... F04B 23/10; F04B 23/14; F01B 13/04

[58] Field of Search ..... 417/201, 203; 91/499–507

[56] References Cited

UNITED STATES PATENTS

| | | | |
|---|---|---|---|
| 2,134,686 | 11/1938 | De Lancey | 417/201 |
| 2,192,539 | 3/1940 | Condon | 91/472 |
| 2,769,393 | 11/1956 | Cardillo | 417/203 |
| 2,870,746 | 1/1959 | Keel | 91/499 |
| 2,945,449 | 7/1969 | Le Febvre | 91/506 |
| 3,049,884 | 8/1962 | Schroeder | 91/506 |
| 3,160,109 | 12/1964 | Kline | 91/487 |
| 3,202,101 | 8/1965 | Tinker et al. | 417/203 |
| 3,249,061 | 5/1966 | Ricketts | 91/486 |
| 3,426,686 | 2/1969 | Anderson | 417/201 |
| 3,499,391 | 3/1970 | Chao et al. | 91/506 |
| 3,654,758 | 4/1972 | Aoyama | 123/179 F |
| 3,657,971 | 4/1972 | Freemann | 417/203 |
| 3,834,281 | 9/1974 | Heyl | 417/222 |

*Primary Examiner*—William L. Freeh
*Attorney, Agent, or Firm*—Phillips, Moore, Weissenberger, Lempio & Majestic

[57] ABSTRACT

A three-section pump including a variable displacement piston pump and an additional rotary pump arranged in axial alignment upon a common drive shaft together with a centrifugal pump, the output for the centrifugal pump being connected to the input for the piston pump in order to assure positive filling. Preferably, the output for the centrifugal pump is also connected with the input for the additional rotary pump in order to also assure its optimum operation. The three-section pump includes a specially configured housing permitting compact assembly of the three-section pump and providing a bearing mount for the common drive shaft of the three-section pump.

6 Claims, 3 Drawing Figures

SUPERCHARGED THREE-SECTION PUMP

BACKGROUND OF THE INVENTION

The present invention relates to a three-section pump of a type including a variable displacement piston pump and an additional rotary pump providing a separate supply of output fluid under pressure. More particularly, the invention relates to such a pump assembly wherein a centrifugal pump is employed for supercharging the variable displacement piston pump.

Variable displacement piston pumps have been commonly employed to deliver fluid under pressure to operate implement systems. The variable displacement piston pump is particularly suited for such applications because of the accurate control permitted over output flow. In addition, the variable displacement piston pump tends to require minimum horsepower when the implement system is in a neutral condition and is not receiving output fluid from the pump.

It is also well known to employ an additional pump, preferably a centrifugal pump, for delivering input fluid to the variable displacement piston pump in order to assure "positive filling" of the variable displacement pump cylinders. Accurate control is thus achieved over output pressure of the variable displacement pump.

Many hydraulic circuits or implement systems require more than one source of fluid under pressure and it is common to provide multiple pumps for such applications. The use of multiple pumps often presents a design problem because of limited available space. This design problem is often even more marked because of the need to provide rugged, simple construction for the pumps and conduits interconnecting the pumps with the hydraulic circuit for the implement system.

SUMMARY OF THE INVENTION

Accordingly, it is an object of the present invention to provide a three-section pump including a variable displacement piston pump, a supercharging pump providing input fluid to the variable displacement pump and an additional rotary pump, the three pumps being arranged in axial alignment upon a common drive shaft.

It is a further object of the invention to provide such a three-section pump wherein the supercharging pump is a centrifugal pump delivering fluid under pressure to inlets for both the variable displacement pump and the additional rotary pump.

It is yet another object of the invention to provide such a three-section pump with a common housing providing a simple and rugged configuration for the pump assembly while facilitating assembly and maintenance of the individual pump sections.

Additional objects and advantages of the invention are made apparent in the following description having reference to the accompanying drawings.

DESCRIPTION OF THE PREFERRED EMBODIMENT

Figure 1:
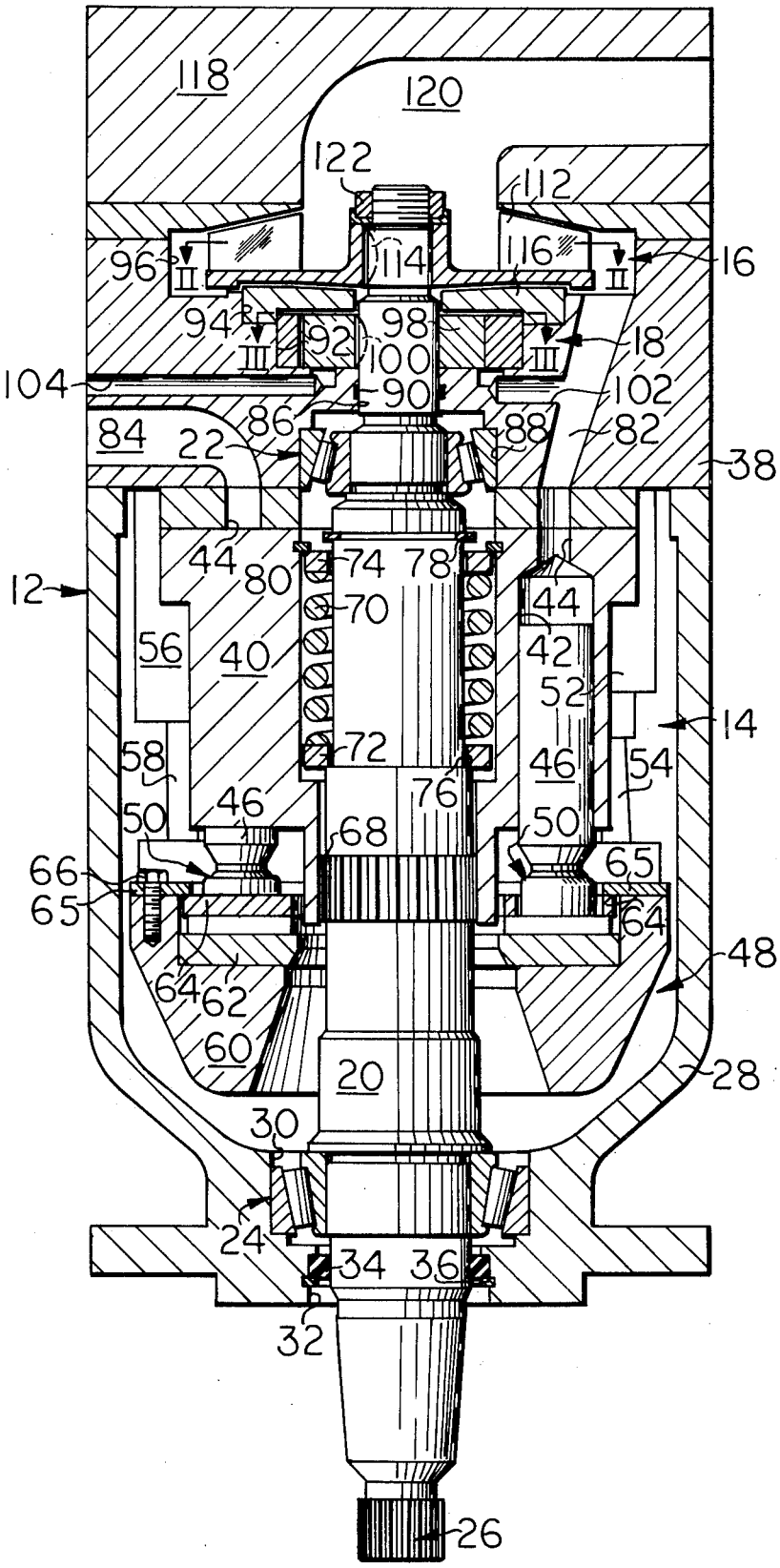
FIG. 1 is an axially sectioned view of a three-section pump constructed according to the present invention.
Figure 2:
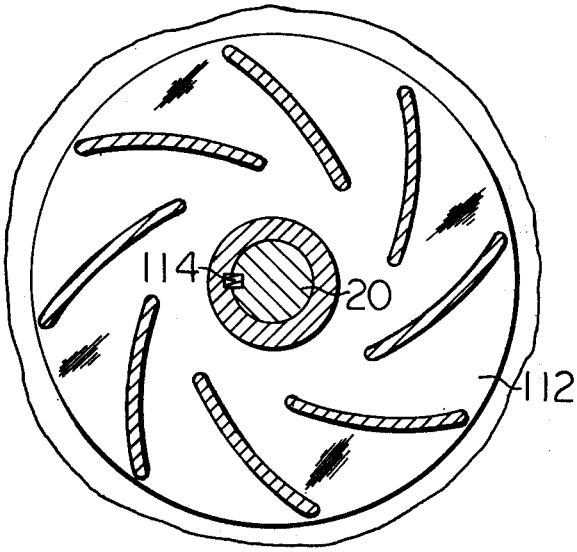
FIG. 2 is a view taken along section line II—II of FIG. 1 to more completely illustrate construction of a supercharging centrifugal pump within the three-section pump assembly.

A three-section pump of the type contemplated by the present invention is generally indicated at 10 in FIG. 1. Specific construction details for the three-section pump are set forth below. However, major components of the pump assembly and their relative arrangement are described first in order to facilitate an understanding of the invention.

The three-section pump 10 includes a pump body 12 formed from a plurality of sections as described below. A variable displacement, piston pump 14 is arranged within one end of body 12. A supercharging centrifugal pump 16 and an additional rotary pump, preferably a gear pump as indicated at 18, are arranged in the opposite end of the pump body 12.

The three pump sections 14, 16 and 18 are arranged in axial alignment and mounted upon a common drive shaft indicated at 20. The pump body 12 also contains two bearing assemblies 22 and 24 arranged at opposite ends of the piston pump 14 for supporting the drive shaft 20. A portion of the drive shaft extends in cantilevered fashion to support both the centrifugal pump 16 and gear pump 18. As will be described in greater detail below, the pump body 12 also includes various seals in order to isolate the pumps from each other.

Generally, it is important that the supercharging centrifugal pump 16 provide inlet fluid under pressure to the piston pump 14. However, the centrifugal pump is preferably arranged so that it can supply input fluid under pressure to both the variable displacement piston pump 14 as well as the gear pump 18.

To proceed with a more detailed description of the three-section pump assembly, the common drive shaft 20 extends outwardly from one end of the pump body 12 adjacent the variable displacement piston pump 14. The projecting end of the drive shaft is formed with gear teeth or threads at 26 to permit coupling of the drive shaft with suitable drive means (not shown).

The variable displacement piston pump 14 is arranged at least in part within a housing 28 forming an end portion of the pump body 12. As viewed in FIG. 1, the lower end of the housing 28 is formed with a counterbore 30 to provide a set for the bearing assembly 24. An additional outwardly facing counterbore 32 is formed to receive a seal member 34 which is retained in place by means of a lock ring 36.

The rotating components of the piston pump 14 are arranged within the housing 28 while a head unit for the piston pump 14 is formed by another portion 38 of the valve body 12. The piston pump 14 includes a rotating pump cylinder barrel 40 forming a plurality of axially extending cylinders such as that indicated at 42. Each of the cylinders 42 is in communication with the head unit 38 by means of an interconnecting passage 44. A piston 46 is slidably arranged within each of the cylinders 42 and extends downwardly for interconnection with a swash plate assembly 48 by means of respective ball joints 50.

Displacement of the piston pump 14 is conventionally adjusted by varying the angular alignment of the swash plate assembly 48 relative to the axis of the pump and the drive shaft 20. The angular alignment of the swash plate assembly 48 is controlled in a conventional manner by means of a hydraulic cylinder having an extendable rod or piston 54 and an additional hydraulic cylinder 56 having an extendable piston 58.

The function of the cylinders 52 and 56 to adjust or control the angular alignment of the swash plate assembly 48 is described in greater detail, for example, by U.S. Pat. No. 3,830,594, issued Aug. 20, 1974, and assigned to the assignee of the present invention. For purposes of the present invention, it is sufficient to understand that the pistons 54 and 58 are pivotably connected to the swash plate assembly 48 and are extendable or retractable in order to establish a selected angular alignment for the swash plate assembly.

The swash plate assembly 48 itself includes a swash plate 60 containing a slipper pad 62. The ball joints 50 for the respective pistons are maintained in engagement with the slipper pad 62 by an annular retaining plate 64 held to the swash plate 60 via bearing pads 111 and by cap screws such as those indicated at 66.

The cylinder barrel 40 is arranged in driven engagement with the drive shaft 20 as indicated at 68 for rotation relative to the head unit 38. The axial position of the drive shaft 20 is of course fixed by the thrust bearings 22 and 24. The cylinder barrel 40 is urged into engagement with the head unit 38 by means of a spring 70 arranged for interaction between spring retainers 72 and 74. The lower spring retainer 72 rests upon a stepped shoulder 76 formed upon the drive shaft 20. The upper spring retainer 74 acts to urge the cylinder barrel 40 upwardly against the head unit 38 by interaction with a lock ring 78 riding in a groove 80 formed by the cylinder barrel 40.

The pump body portion 38 which forms the head unit for the piston pump 14 includes a number of elements for the three-section pump which contribute importantly to the compact arrangement of the pump assembly 10. Initially, the fixed head unit 38 forms an inlet passage 82 disposed for register with the interconnecting passages 44 in the cylinder barrel 40. The head unit 38 also forms an outlet passage 84 which is similarly arranged for register with the interconnecting passages 44. When the swash plate assembly 48 is maintained in a selected angular alignment relative to the pump axis, the pistons 46 are retracted from the cylinders 42 to draw fluid from the inlet passage 82 and again extended to deliver fluid under pressure into the outlet passage 84.

The body portion 38 also forms chambers as described in greater detail below for containing both the gear pump 18 and the centrifugal pump 16 while also providing means for isolating the pump sections from each other. In accomplishing these purposes, the body portion 38 is initially formed with a bore 86 for receiving the drive shaft 20. The body unit 38 also forms a counterbore 88 facing the piston pump 14 to receive the thrust bearing assembly 22. An elastomeric O-ring 90 is arranged within a groove formed by the bore 86 in order to provide a fluid seal.

Figure 3:
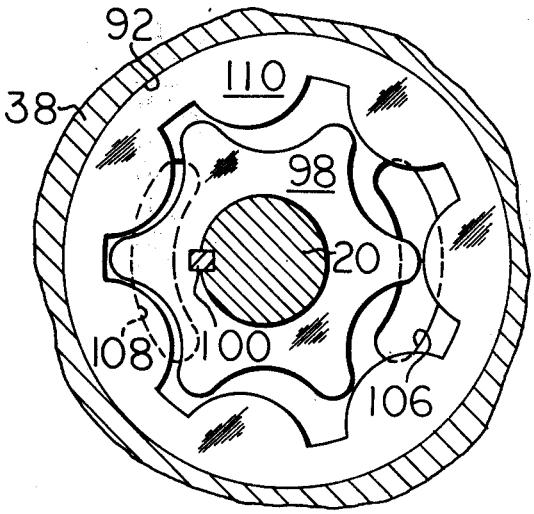
FIG. 3 is a view taken along section III—III of FIG. 1 to more completely illustrate construction of an additional rotary pump within the three-section pump assembly.

The opposite end of the body portion 38 is formed with three stepped counterbores indicated respectively at 92, 94 and 96. The first counterbore 92 contains the various movable elements of the gear pump 18 as may be better seen in FIG. 3. Basically, the gear pump 18 includes a pumping gear 98 secured to the common drive shaft 20 by means of an interlocking key 100. An inlet passage for the gear pump 18 is formed at 102 by the body portion 38. As may be best seen in FIG. 1, the inlet passage 102 is a branch of the inlet passage 82 for the piston pump 14. An outlet passage 104 is similarly formed for the gear pump 18 by means of the body portion 38. Having reference also to FIG. 3, the body portion 38 additionally forms an annular inlet port 106 and an annular outlet port 108 connected respectively with the passages 102 and 104 and intermittently entering into register with the passages 44. The pumping gear 98 is driven in rotation by the shaft 20 and cooperates with a surrounding gear insert 110 to receive fluid from the inlet passage 102 and inlet port 106 while delivering fluid under pressure to the outlet port 108 and the outlet passage 104.

The third stepped counterbore 96 is similarly arranged to receive and contain a centrifugal impeller 112 which is also keyed to the common drive shaft 20 as indicated at 114. Inlet fluid is delivered to the centrifugal pump in a manner described below. Outlet fluid from the centrifugal pump, however, is delivered into the passage 82 in order to provide fluid under pressure to both the connecting passages 44 for the piston pump as well as the branched inlet passage 102 for the gear pump 18.

The second stepped counterbore 94 is arranged to receive an annular spacer plate 116 which separates the centrifugal pump 16 from the gear pump 18 while also facilitating assembly of the entire pump unit 10 in a manner described below.

A final end portion 118 for the pump body 12 is arranged in abutting engagement with the body portion 38 and forms an inlet passage or port 120 for the centrifugal pump 16. The centrifugal pump 16 operates to draw fluid from the inlet passage 120 and deliver it through the passage 82 for delivery to both the piston pump 14 and the gear pump 18. The impeller 112 for the centrifugal pump 16 is secured upon the drive shaft 20 by means of a threaded nut indicated at 122.

The upper end of the common drive shaft 20, as viewed in FIG. 1 and extending in cantilevered fashion beyond the thrust bearing assembly 22 supports both the pumping gear 98 for the gear pump 18 and the impeller 112 for the centrifugal pump 16. This feature together with the construction of the pump body 12 and the design of the centrifugal and gear pumps with the intermediate spacer plate 116 greatly facilitates assembly of the entire three-section pump 10. For example, the drive shaft and rotating components of the piston pump 14 may first be assembled within the housing 28. The body portion or head unit 38 may then be added with the common drive shaft 20 being supported by the two thrust bearing assemblies 22 and 24. With the body portion 38 in place, the gear pump 18 may then be readily arranged within the first counterbore 92 followed by insertion of the spacer plate 94. The centrifugal impeller 112 may be locked in place by means of the nut 122. The end portion 118 of the pump body 112 may then be secured in place to complete construction of the three-section pump.

We claim:

1. A three-section pump assembly comprising a pump body a variable displacement piston pump arranged generally toward one axial end of the body and having a stationary head unit formed by a portion of pump body, a drive shaft for the piston pump extending in cantilevered fashion through the head unit, a supercharging centrifugal pump and an additional positive displacement rotary pump being arranged in axial alignment with the piston pump and having rotary portions mounted in driving relation upon the cantilevered end of the common drive shaft, the positive displacement rotary pump disposed between the centrifugal pump and the piston pump, each of the centrifugal and positive displacement rotary pumps including respective fluid inlets and fluid outlets, the fluid outlet for the supercharging centrifugal pump being in communication with an inlet for the variable displacement piston pump, and the fluid inlet for the positive displacement rotary pump in communication with the fluid outlet of the supercharging centrifugal pump, the head unit portion of the pump body formed with three stepped counterbores, the positive displacement rotary pump being arranged within a first one of the counterbores and the centrifugal pump being arranged with the third one of the stepped counterbores, a spacer means being arranged within the second stepped counterbore in order to separate the centrifugal pump from the gear pump.

2. The three-section pump assembly of claim 1 wherein the body includes an end housing section for containing rotating portions of the piston pump, the end housing portion and the fixed head unit containing thrust bearing mounts for axially positioning the common drive shaft.

3. The three-section pump of claim 2 wherein the additional rotary pump is a gear pump.

4. The three-sectioned pump assembly of claim 3 wherein the thrust bearing mount contained in the fixed head unit is disposed between the gear pump and the piston pump.

5. A three-sectioned pump including a variable displacement piston pump, a super-charging centrifugal pump and an additional positive displacement rotary pump, the three-section pump comprising a pump body including a first section for housing rotary components of the piston pump and a second portion forming a non-rotating head unit for the piston pump, a common drive shaft for the three pumps extending axially through the first body portion and arranged upon thrust bearings supported by the first body portion and the seond body portion, the second body portion forming three stepped counterbores for respectively receiving the centrifugal and the additional positive displacement rotary pump with an intermediate spacer means to divide the centrifugal and additional positive displacement rotary pumps, the second body portion also forming inlet and outlet passages for the rotary pump, an outlet passage for the piston pump and a common passage for directing output fluid from the super-charged centrifugal pump to the piston pump and the additional positive displacement rotary pump, and a third body portion arranged opposite the second body portion from the first body portion and defining an inlet passage for the super-charging centrifugal pump, the additional positive displacement rotary pump disposed between the centrifugal pump and the piston pump, and further the thrust bearing means supporting the common drive shaft and located in the second body portion disposed between the positive displacement rotary pump and the piston.

6. The three-section pump of claim 5 wherein the additional rotary pump is a gear pump.

* * * * *